US006510802B2

(12) United States Patent
Huang et al.

(10) Patent No.: US 6,510,802 B2
(45) Date of Patent: Jan. 28, 2003

(54) CARRIER FOR ROLLS OF METAL SHEET

(75) Inventors: Kun Jung Huang, Taipei (TW); Shao Hua Lui, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 36 days.

(21) Appl. No.: 09/745,050

(22) Filed: Dec. 20, 2000

(65) Prior Publication Data

US 2002/0056796 A1 May 16, 2002

(51) Int. Cl.[7] ..... B65D 19/38; B65D 19/00

(52) U.S. Cl. ..... 108/57.17; 248/346.01; 108/51.3

(58) Field of Search ..... 248/346.01, 346.02, 248/346.03, 682, 687, 78, 89; 108/55.1, 57.12, 57.17, 51.3; 428/131

(56) References Cited

U.S. PATENT DOCUMENTS 3,875,617 A * 4/1975 Cline ..... 24/16 R
4,526,500 A * 7/1985 Patrick ..... 410/48
4,796,540 A * 1/1989 Pelfrey ..... 108/55.3
4,995,512 A * 2/1991 Liebel ..... 206/396
5,236,087 A * 8/1993 Morgan ..... 206/397
5,636,577 A * 6/1997 Gow ..... 108/51.1
5,861,204 A * 1/1999 O'Sullivan ..... 428/131

* cited by examiner

*Primary Examiner*—Anita King
(74) *Attorney, Agent, or Firm*—Wei Te Chung

(57) ABSTRACT

A carrier (10) for carrying a roll of metal sheet includes a base (20), an arcuate support plate (50), a cushion (60) and a vertical shield (80). The base includes a top wall (22), and is adapted to removably engage with a transportation machine. The support plate is attached to the top wall, for providing maximum contact area between the carrier and a center hole of the roll. The shield is attached to the top wall, for preventing a side of the roll from being damaged by the transportation machine. The cushion is attached to the support plate, for preventing surface damage to the roll. A reinforcing plate (54) is attached to the top wall, for underpinning the support plate.

9 Claims, 2 Drawing Sheets

CARRIER FOR ROLLS OF METAL SHEET

BACKGROUND OF THE INVENTION

1. Field of the Invention

The present invention relates to a carrier, and more particularly a carrier which is used to carry rolls of metal sheet.

2. Prior Art

In a variety of manufacturing industries, many metal sheets are used. Generally, the size of the plates is great. This makes transportation of the plates difficult. Therefore metal sheets are wound into rolls for facilitating transportation. Various carriers are used to move rolls of metal sheet.

A conventional carrier includes a forklift, a base, and a boom. The base is inserted into a center hole of a roll of metal sheet, whereupon the roll is carried from one place to another.

However, the base of the carrier is conventionally elongated, and the contact area between the base and the roll of metal sheet is minimal. The sheer weight of the roll itself often results in its deformation. Additionally, the base is frequently uneven, rendering the roll prone to surface damage.

An improved carrier which resolves the above-mentioned problems is desired.

SUMMARY OF THE INVENTION

Accordingly, an object of the present invention is to provide a carrier for rolls of metal sheet which prevents the rolls from being damaged.

To achieve the above-mentioned object, a carrier in accordance with the present invention comprises a base, an arcuate support plate, a cushion and a vertical shield. The base has a top wall, and is adapted to removably engage with a transportation machine. The support plate is attached to the top wall, for providing maximum contact area between the carrier and a center hole of the roll. The shield is attached to the top wall, for preventing a side of the roll from being damaged by the transportation machine. The cushion is attached to the support plate, for preventing surface damage to the roll. A reinforcing plate is attached to the top wall, for underpinning the support plate.

Other objects, advantages and novel features of the present invention will be drawn from the following detailed embodiment of the present invention with attached drawings, in which:

DETAILED DESCRIPTION OF THE PREFERRED EMBODIMENT

Figure 1:
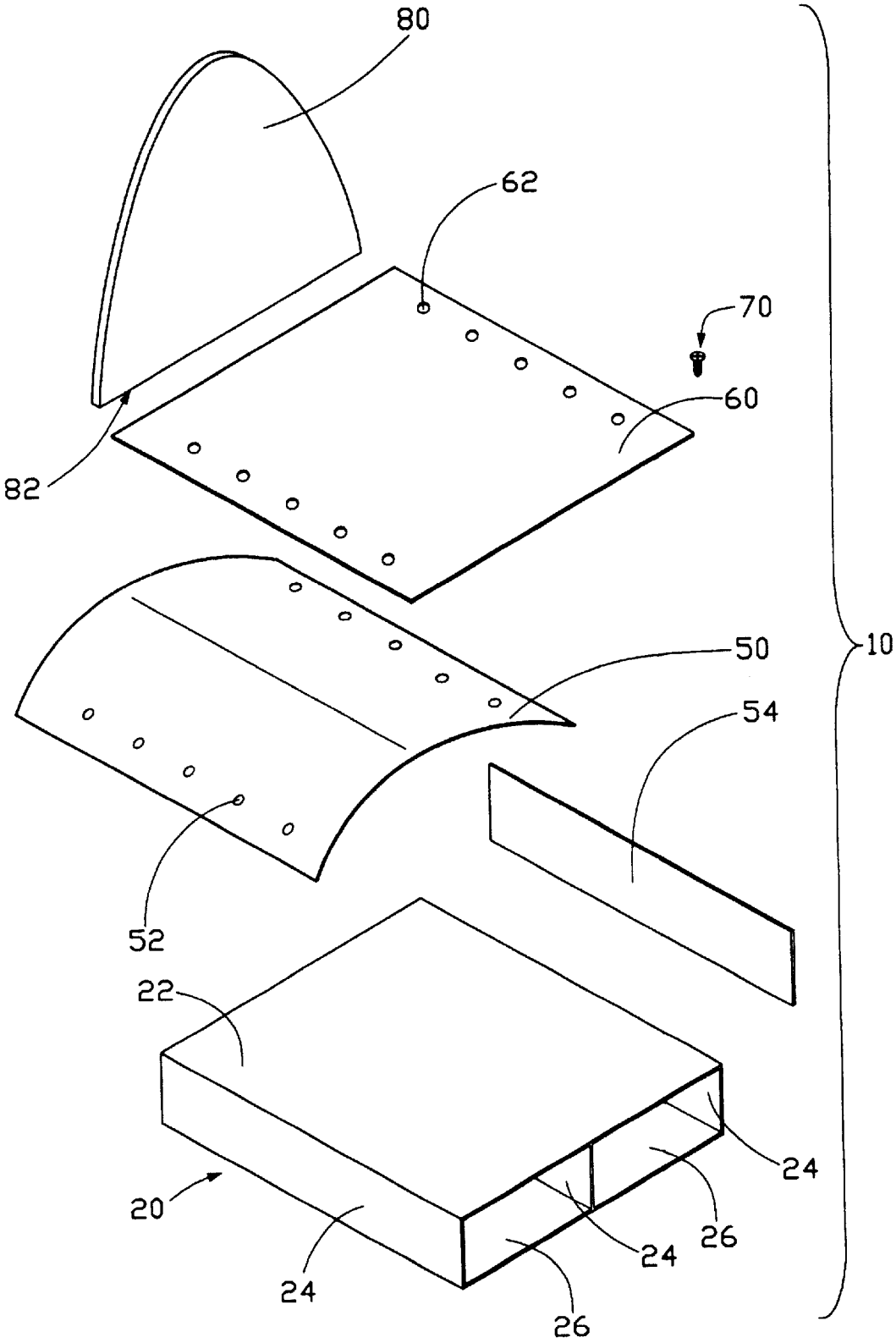
FIG. 1 is an exploded view of a carrier in accordance with the present invention.

FIG. 1 shows a carrier 10 in accordance with the present invention. The carrier 10 includes a base 20, a support plate 50, a cushion 60, a plurality of screws 70, and a shield 80.

The base 20 is substantially box-shaped and hollow. The base 20 comprises a top wall 22, and three support walls 24 between the top wall 22 and a bottom wall (not labeled) of the base 20. A pair of symmetrical through cavities 26 separated by one central support wall 24 is thus defined inside the base 20. The cavities 26 receive arms of a transportation machine such as a forklift (not shown).

The support plate 50 is arcuate, and is dimensioned to substantially accord with the size of a center hole of a roll of metal sheet. The support plate 50 has a width no less than that of the top wall 22 of the base 20, and a length slightly less than that of the top wall 22 of the base 20. A plurality of aligned screw holes 52 is defined at respective opposite longitudinal sides of the support plate 50. A reinforcing plate 54 underpins the support plate 50.

The cushion 60 is made of a flexible cushioning material such as rubber. The cushion 60 is bent to be arcuate, to cover the support plate 50. A plurality of bores 62 is defined in respective opposite longitudinal sides of the cushion 60, corresponding to the holes 52 of the support plate 50. Screws 70 attach the cushion 60 to the support plate 50.

The shield 80 is planar, and has an arch-shaped top edge (not labeled) and a linear bottom edge 82.

Figure 2:
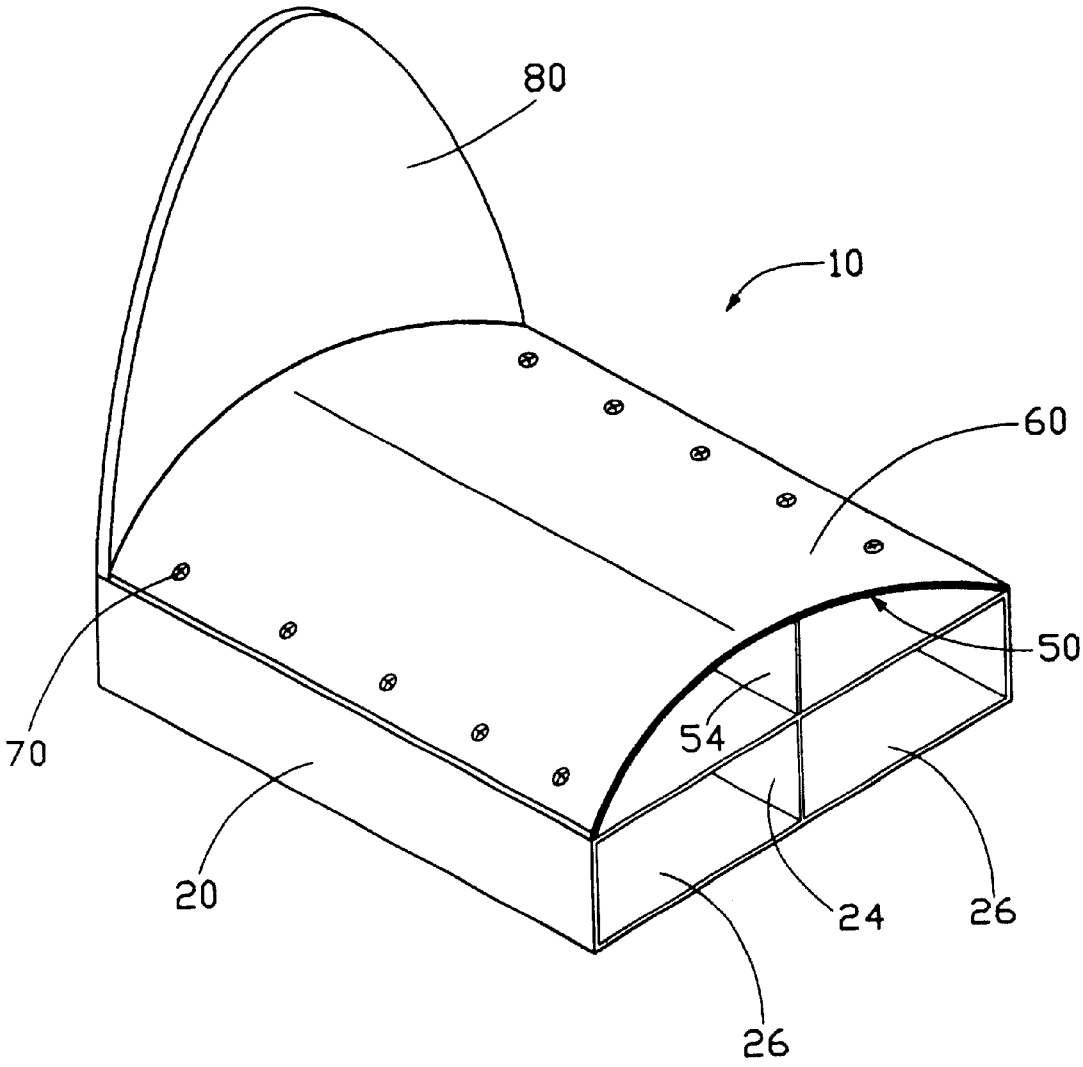
FIG. 2 is an assembled view of FIG. 1.

Referring also to FIG. 2, in assembly, the reinforcing plate 54 is welded to the top wall 22 of the base 20, such that sufficient area remains above the top wall 22 for accommodating the shield 80. The support plate 50 is welded to the top wall 22 of the base 20. A top edge of the reinforcing plate 54 now abuts a bottom surface of the support plate 50. The bottom edge 82 of the shield 80 is welded to the top wall 22 of the base 20, such that the shield 80 abuts an end edge of the support plate 50. The cushion 60 is then attached to the support plate 50 with the screws 70.

In operation of the carrier 10, the forklift causes the base 20 with the support plate 50 thereon to be inserted into the center hole of the roll. The shield 80 prevents a side of the roll from being damaged by contact with the forklift. When the forklift moves the roll, the cushion 60 on the support plate 50 abuts inmost metal sheet of the roll. A large contact area between the cushion 60 and the inmost metal sheet is established. This results in minimal force per unit area operating between the cushion 60 and the inmost metal sheet. The roll is thereby protected from any deformation which might otherwise occur by means of its own weight. Moreover, the cushion 60 prevents surfaces of the inmost metal sheet from being damaged. The reinforcing plate 54 enhances the support capability of the support plate 50. The cavities 26 of the base 20 are symmetrically separated by the support walls 24 of the base 20, for maintaining balance of the carrier 10. Thus the roll can be safely carried about without being damaged.

It is understood that the invention may be embodied in other forms without departing from the spirit thereof. Thus, the present example and embodiment is to be considered in all respects as illustrative and not restrictive, and the invention is not to be limited to the details given herein.

What is claimed is:

1. A carrier for carrying a roll of metal sheet having a central hole, comprising:

a base adapted to extend into the hole of the roll, and comprising a top wall; and a support plate attached to the top wall of the base, the support plate having an arcuate outer surface adapted to be in surface contact with an inner surface of the metal sheet.

2. The carrier as recited in claim 1, wherein a cushion is attached to the arcuate outer surface of the support plate, for preventing the roll from being damaged.

3. The carrier as recited in claim 2, wherein the support plate defines a plurality of screw holes, the cushion defines a plurality of bores corresponding to the screw holes, and a plurality of screws extends into the bores and the screw holes for attaching the cushion to the support plate.

4. The carrier as recited in claim 1, wherein at least one reinforcing plate is attached to the top wall of the base, for supporting the support plate.

5. The carrier as recited in claim 1, wherein a shield is attached to the top wall of the base, for preventing the roll from being damaged.

6. The carrier as recited in claim 5, wherein the shield has a linear bottom edge, to facilitate attachment of the shield to the top wall of the base.

7. The carrier as recited in claim 1, wherein the base comprises at least three support walls extending from the top wall to define at least two through cavities, the cavities adapted to removably receive arms of a transportation machine.

8. A carrier for carrying a roll of metal sheet having a central hole, comprising:

a base adapted to extend into the hole of the roll, and comprising a top wall; and a support plate attached to the top wall of the base, the support plate having an arcuate outer surface adapted to contact an inner surface of the metal sheet;

wherein at least one reinforcing plate is attached to the top wall of the base, for supporting the support plate.

9. A carrier for carrying a roll of metal sheet having a central hole therein, comprising:

a base adapted to be properly received in the central hole of the roll;

at least one support plate disposed on the base and providing thereon a convex outer surface configured to be adapted to be compliantly in surface contact with an inner surface of the roll of metal sheet; and at least a cushion layer compliantly attached on a top of the support plate opposite to the base; wherein the cushion is adapted to be sandwiched between the support plate and the inner surface of the roll of metal sheet.

* * * * *